US009388724B2

(12) United States Patent
Noller et al.

(10) Patent No.: US 9,388,724 B2
(45) Date of Patent: Jul. 12, 2016

(54) EXHAUST GAS TREATMENT DEVICE

(75) Inventors: Christoph Noller, Königsbrunn (DE); Erich Forster, Grossaitingen (DE); Manfred Stiglmair, Thierhaupten (DE)

(73) Assignee: Faurecia Emissions Control Technologies, Germany GmbH, Augsburg (DE)

( * ) Notice: Subject to any disclaimer, the term of this patent is extended or adjusted under 35 U.S.C. 154(b) by 1591 days.

(21) Appl. No.: 12/745,964

(22) PCT Filed: Dec. 5, 2008

(86) PCT No.: PCT/EP2008/010346

§ 371 (c)(1),
(2), (4) Date: Sep. 2, 2010

(87) PCT Pub. No.: WO2009/071316

PCT Pub. Date: Jun. 11, 2009

(65) Prior Publication Data

US 2010/0319314 A1 Dec. 23, 2010

(30) Foreign Application Priority Data

Dec. 6, 2007 (DE) ..... 10 2007 058 791

(51) Int. Cl.
*F01N 3/00* (2006.01)
*F01N 3/28* (2006.01)

(52) U.S. Cl.
CPC ..... *F01N 3/2839* (2013.01); *F01N 3/2875* (2013.01); *F01N 2350/04* (2013.01)

(58) Field of Classification Search
None
See application file for complete search history.

(56) References Cited

U.S. PATENT DOCUMENTS

| | | | | | |
|---|---|---|---|---|---|
| 2,185,584 | A | * | 1/1940 | Boyce | 55/517 |
| 3,817,714 | A | * | 6/1974 | Wiley | 422/173 |
| 3,945,803 | A | * | 3/1976 | Musall et al. | 422/179 |
| 3,947,252 | A | | 3/1976 | Musall et al. | |
| 3,948,611 | A | * | 4/1976 | Stawsky | 422/179 |
| 3,989,471 | A | * | 11/1976 | Nowak | 422/179 |
| 4,004,887 | A | * | 1/1977 | Stormont | 422/179 |
| 4,161,509 | A | * | 7/1979 | Nowak | 422/179 |
| 4,224,285 | A | * | 9/1980 | Mayer | 422/179 |
| 4,383,975 | A | * | 5/1983 | Fratzer et al. | 422/176 |
| 5,863,311 | A | * | 1/1999 | Nagai et al. | 55/483 |
| 6,991,668 | B2 | * | 1/2006 | Towsley | 55/525 |

FOREIGN PATENT DOCUMENTS

| | | | |
|---|---|---|---|
| DE | 2216772 | A1 | 10/1973 |
| DE | 2313156 | A1 | 9/1974 |
| DE | 2412567 | A1 | 9/1974 |
| DE | 2318126 | A1 | 10/1974 |
| DE | 3512580 | A1 | 10/1986 |

OTHER PUBLICATIONS

International Search Report dated Mar. 17, 2009.
English translation of IPRP, dated Jul. 6, 2010.

* cited by examiner

*Primary Examiner* — Jesse Bogue
(74) *Attorney, Agent, or Firm* — Carlson, Gaskey & Olds, PC

(57) ABSTRACT

An exhaust gas treatment device has a housing and a hollow body through which exhaust gas flows and which is accommodated in the housing. The hollow body consists at least partly of a gas permeable substrate. The hollow body is connected at least one end to a wall member arranged in the housing and formed to be flexible in the axial direction.

12 Claims, 15 Drawing Sheets

Fig. 5
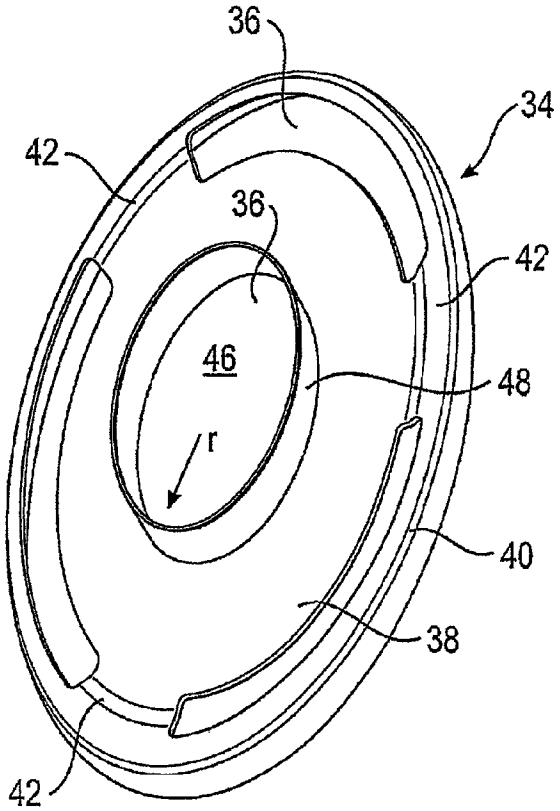
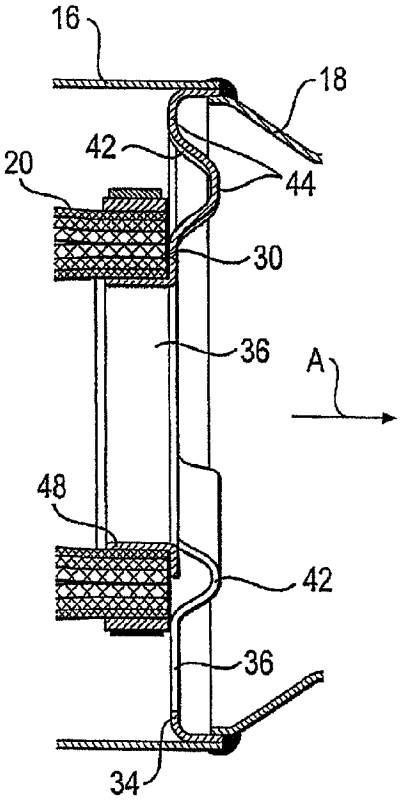
Fig. 6

Fig. 12
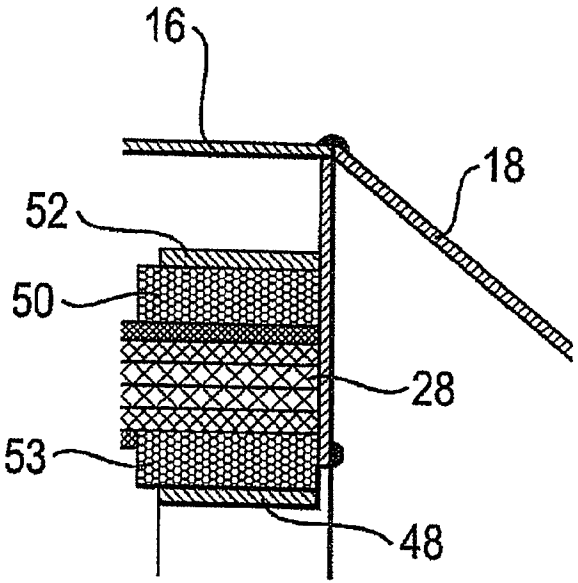
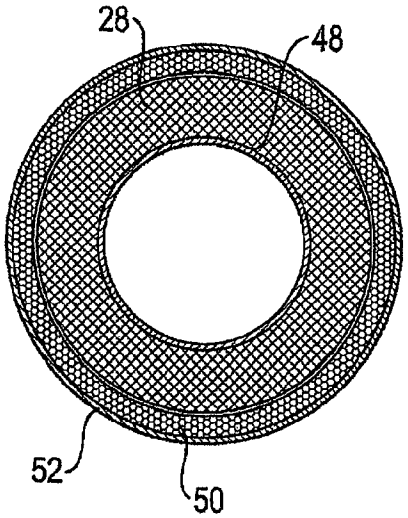
Fig. 11
Fig. 10
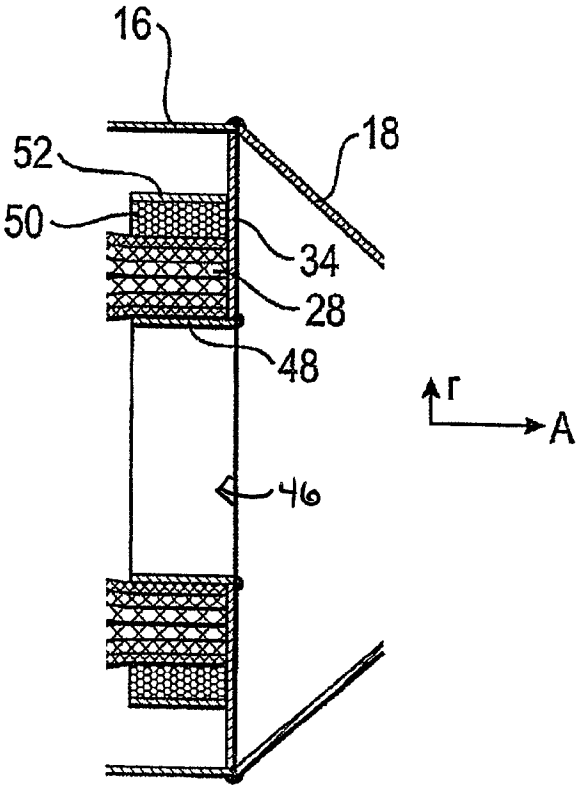

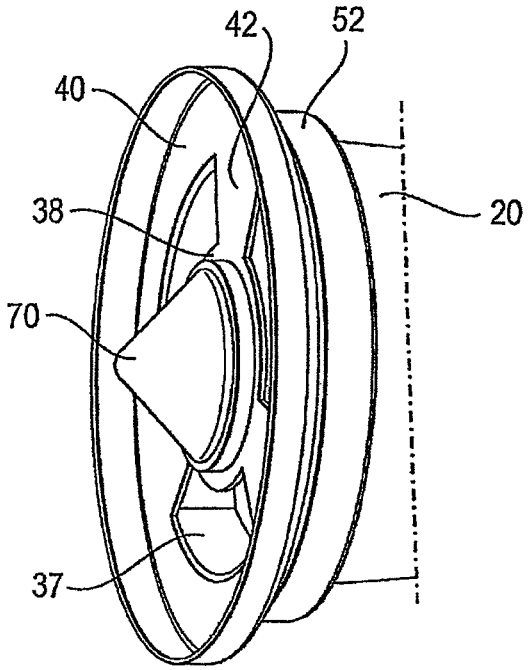
Fig. 34
Fig. 36
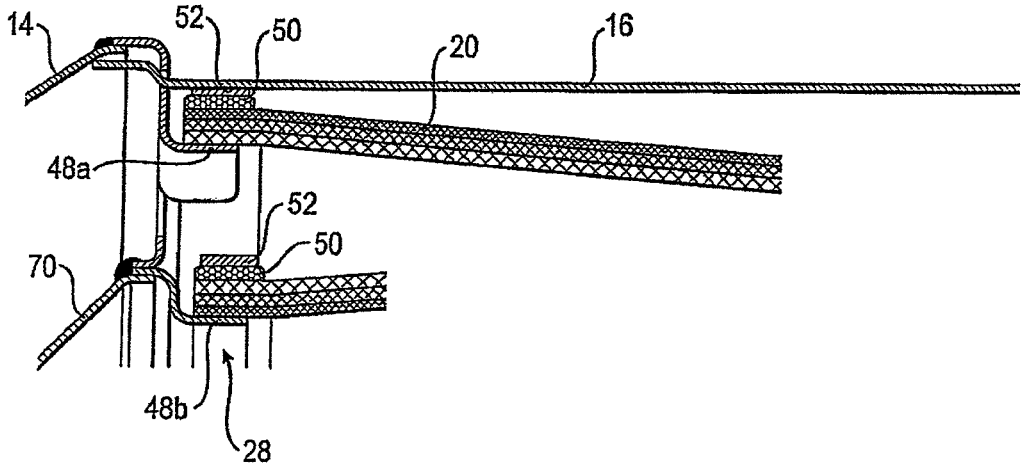

EXHAUST GAS TREATMENT DEVICE

RELATED APPLICATION

This application is the U.S. national phase of PCT/EP2008/010346 filed Dec. 5, 2008, which claims priority to DE 10 2007 058 791.2 filed Dec. 6, 2007.

BACKGROUND

The present invention relates to an exhaust gas treatment device.

For the treatment, more particularly for the purification, of exhaust gases of internal combustion engines, e.g., diesel engines of passenger automobiles, it is known to arrange porous, gas permeable substrates in a closed housing in an exhaust pipe, so that the exhaust gas flows through the substrate.

To this end, it is known to bring the substrate into the shape of a hollow body having one or more walls, the hollow body being arranged in the housing such that the exhaust gas must always flow through at least one wall of the hollow body in order to pass from the entrance of the housing to the exit thereof.

Possible geometries to be used for the hollow body include, e.g., a pair of truncated cones fitted inversely into each other or a pair of cylinders arranged concentrically in relation to each other.

To form the substrate for the hollow body, plates made from a metal foam, a metal sponge or else a metallic hollow sphere structure are used, for example, which may be coated with a catalytically active material. An exhaust gas treatment may be effected, e.g., by chemical conversion, mechanical deposition of particles, e.g., soot particles, carried along with the exhaust gas, in the pores of the substrate, or by a combination of different methods.

The hollow body, in particular a hollow body made from metal foam plates, and the housing, which in most cases consists of sheet metal, have, however, different coefficients of thermal expansion, which become noticeable with exhaust gas temperatures that may amount to several hundred degrees Celsius. An additional complication is that the substrate is relatively brittle and is therefore highly stressed by different linear expansions of the hollow body and of the housing.

It is the object of the invention to present an approach that takes the different dimensions of the hollow body and of the housing into account in a simple way.

SUMMARY

This is achieved by an exhaust gas treatment device including a housing and at least one hollow body through which exhaust gas flows and which is accommodated in the housing. The hollow body consists at least partly of a gas permeable substrate and is connected at least one end to a wall member which is arranged in the housing and is formed to be flexible in the axial direction. The different dimensions which are caused by different linear expansions of the hollow body and of the housing, for example, are compensated by the wall member, so that any excessive load on the substrate of the hollow body is avoided.

The wall member is preferably arranged inside the housing, for example in the nature of a partition wall. It is preferably not part of an outer housing of the exhaust gas treatment device.

The wall member may be configured in the form of an inner annular segment and an outer annular segment, for example, which are connected to each other by at least two webs. The axial flexibility is obtained through the webs here, so that the inner annular segment can move in relation to the outer annular segment in the axial direction. By selecting the number, shape, dimensions and material thickness of the webs, it is possible to adjust both the maximum deflection of the inner annular segment in relation to the outer annular segment and the force required for the deflection in a simple manner and within a broad scope.

To increase their flexibility, the webs may include at least one section that is arched out of a plane of the wall member in the radial direction. Viewed in the radial direction, the web has an undulating shape with one or more crests and troughs, for example. This shape increases the flexibility in the axial direction.

For an increase in its inherence stiffness, the inner annular segment may include a stiffening profile, for example in the form of a continuously surrounding embossing.

The inner annular segment may also include a bent-over edge to increase the inherent stiffness.

Preferably, the hollow body is attached to the inner annular segment. The outer annular segment, on the other hand, is preferably attached to the housing. This ensures the axial mobility of the hollow body in relation to the housing, whereas both the attachment of the hollow body to the wall member and the attachment of the wall member to the housing are effected without any play whatsoever.

To attach the hollow body, the wall member has, e.g., an axial extension formed thereon, at which the end of the hollow body is fixed in place. This type of attachment provides a large support surface for the substrate of the hollow body and it is therefore possible to use an attachment which, as viewed over the circumference of the hollow body, exerts a uniform pressure on the substrate. The axial extension is preferably adjusted precisely to the diameter of the end of the hollow body. This may be performed by a calibration of the hollow body to the measurements of the extension or else by a calibration of the measurements of the extension to those of the hollow body.

A stiffening profile and/or a bent-over edge on the inner annular segment may also be employed additionally for attaching the hollow body, e.g. in that a flexible fastening is accommodated there.

The wall member is preferably attached in the region of a transition from an inlet region to a flow-through region of the housing, or in the region of the transition from the flow-through region to an outlet region of the housing. The wall member may also serve as an inner partition wall and for guiding the flow, the intermediate spaces between the inner and outer annular segments purposefully determining an inflow slot into the hollow body, through which the exhaust gas is guided into the hollow body.

It is possible to provide a flexible wall member only at one end of the hollow body or at both ends of the hollow body.

BRIEF DESCRIPTION OF THE DRAWINGS

Further features and advantages of the invention will be apparent from the following description of several exemplary embodiments given with reference to the accompanying drawings, in which:

FIG. 5 shows a schematic sectional view of a section of an exhaust gas treatment device according to the invention with a flexible wall member;

FIG. 6 shows the flexible wall member of FIG. 5 in a perspective illustration;

FIGS. 10 to 14 schematically show a first variant of the attachment of a hollow body of an exhaust gas treatment device according to the invention in a housing;

FIG. 34 shows a schematic perspective illustration of a wall member including a flow guide member as shown in FIG. 31;

FIG. 36 shows a schematic sectional view of a section of an exhaust gas treatment device according to the invention.

DETAILED DESCRIPTION

Figure 1:
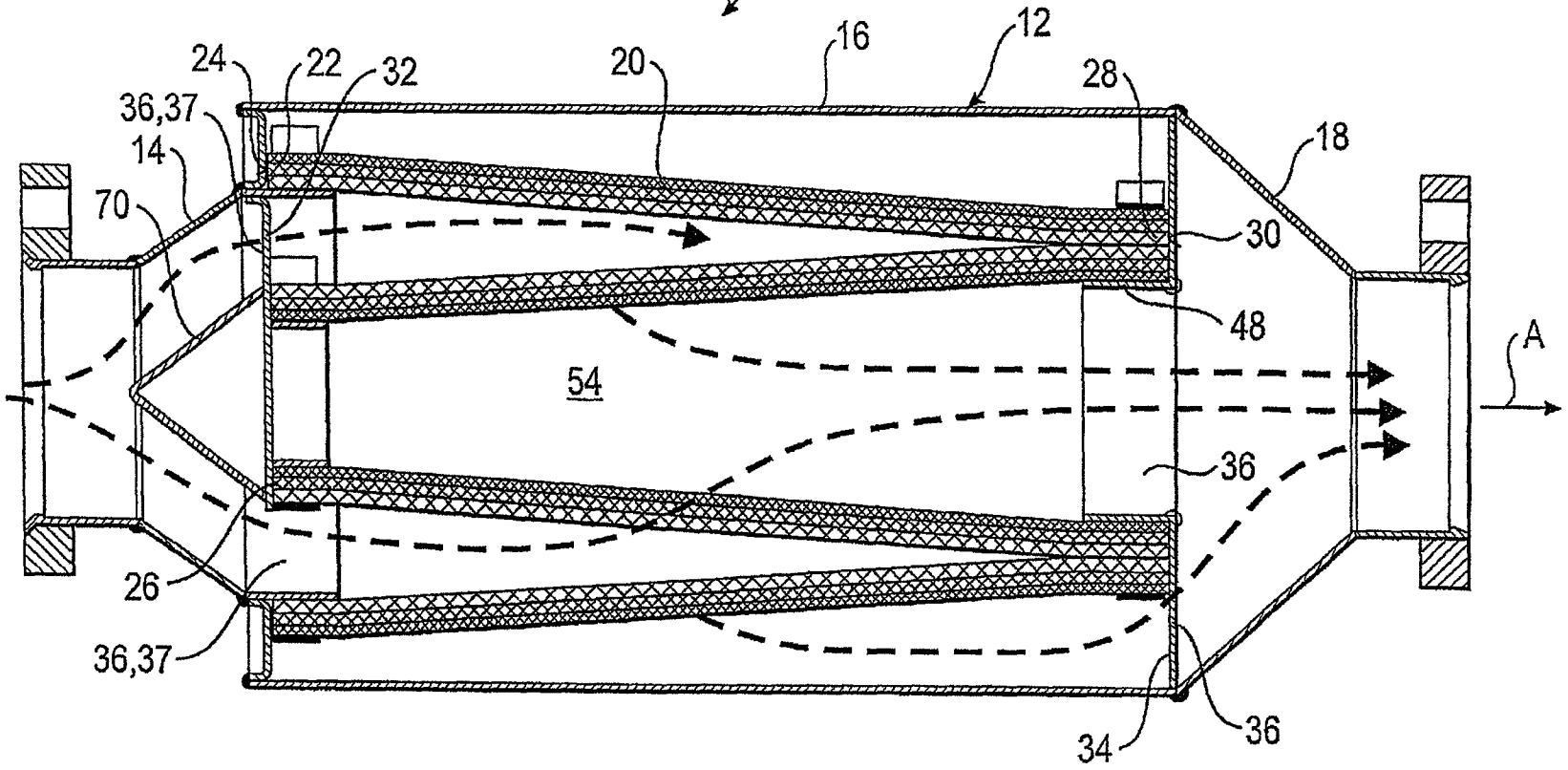
FIG. 1 shows a schematic sectional view of an exhaust gas treatment device according to the invention.

FIG. 1 shows an exhaust gas treatment device 10 for an internal combustion engine. The exhaust gas treatment device 10 is inserted in an exhaust pipe, which is indicated only schematically at the two outer ends of the exhaust gas treatment device 10, and is positioned in the exhaust gas stream flowing through this exhaust pipe. It includes a housing 12 having a funnel-shaped inlet region 14 situated on the left-hand side in FIG. 1, a flow-through region 16 adjacent thereto in the flow direction, and a funnel-shaped outlet region 18 adjacent to the flow-through region 16 in the flow direction, which is located on the right-hand side of the housing 12 in FIG. 1. The housing 12 is sealed to the outside and is also connected to the exhaust pipe so as to be gas-tight, so that all of the exhaust gas must flow though the housing 12. The housing 12 is advantageously formed from a temperature-resistant and dimensionally stable sheet metal.

Accommodated in the housing 12 is a hollow body 20 which is disposed in the flow path of the exhaust gas, so that the exhaust gas must flow through at least one wall of the hollow body 20 to pass from the inlet region 14 to the outlet region 18. The hollow body 20 here consists of a plurality of layers of a gas permeable substrate, e.g. of metal foam or metal sponge plates or plates made from a metallic hollow sphere structure or any other suitable substrate material. The exhaust gas treatment device 10 may be a particulate filter, for example, in which soot particles are filtered out of the exhaust gas. In the present example, the substrate of the hollow body 20 is coated with a catalytically active material, as is known in connection with similar devices.

In the cases shown here, the hollow body 20 is formed from two members in the form of a pair of truncated cones fitted inversely into each other. On a first end 22 (on the left in FIG. 1), the hollow body 20 includes a pair of annular front faces 24, 26 positioned concentrically inside each other. On the opposite side, on a second end 28 (on the right in FIG. 1), the hollow body 20 has a single annular front face 30, in which both members of the hollow body lie on top of each other.

Each of the members of the hollow body 20 consists, for example, of three layers of substrate plates, which may have different properties, e.g. different porosities.

Figure 2:
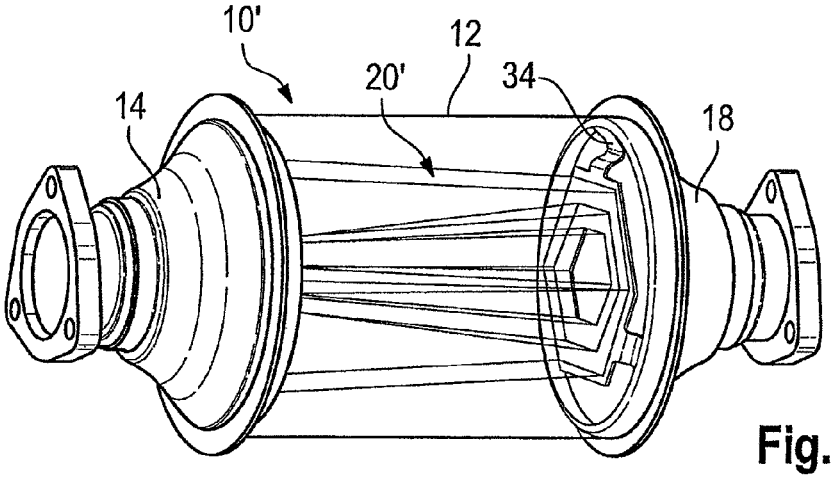
FIGS. 2, 3 and 4 show schematic views of a variant of an exhaust gas treatment device according to the invention.
Figure 3:
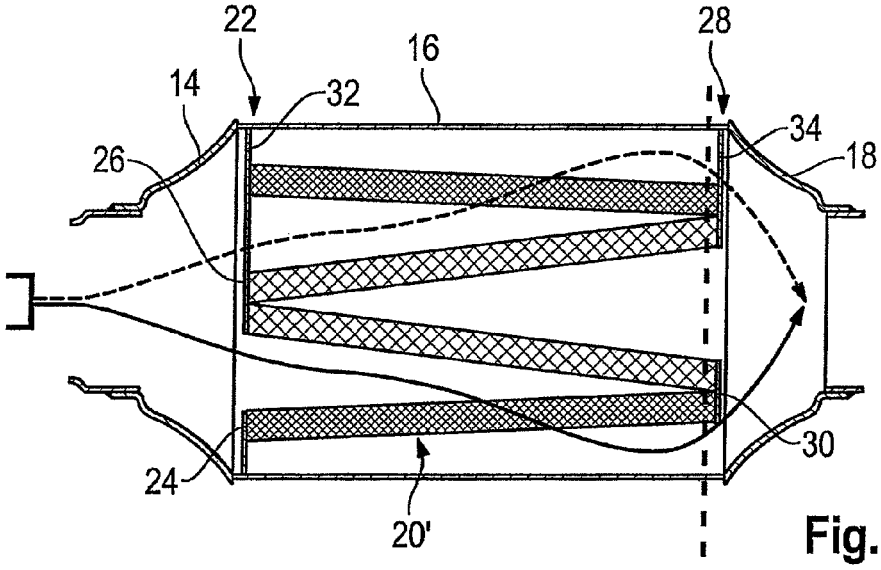
Figure 4:
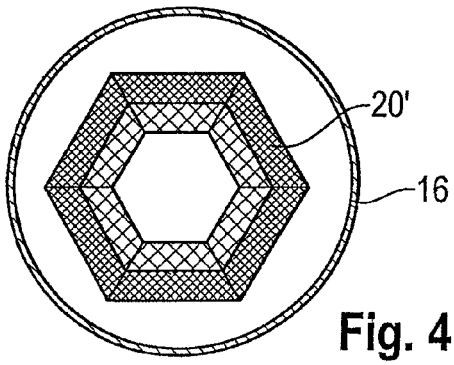

FIGS. 2 to 4 show a variant 10' of the exhaust gas treatment device 10 of FIG. 1. In this case, the hollow body 20' is composed of a plurality of individual, flat substrate plates. Altogether, the hollow body 20' has the shape of two truncated pyramids which are each hexagonal and are placed inversely one inside the other.

The hollow body 20 is attached on each of the two ends 22, 28 to a respective wall member 32, 34 disposed completely inside the housing 12, both wall members 32, 34 being oriented perpendicularly to the axial direction A. The first wall member 32 is situated at the transition from the inlet region 14 to the flow-through region 16, while the second wall member 34 is situated at the transition from the flow-through region 16 to the outlet region 18. In this example, both wall members 32, 34 consist of a temperature-resistant sheet metal. They are firmly connected to the outer wall of the housing 12 without clearance.

The wall members 32, 34 each leave flow-through sections 36 open, which on the inlet side constitute a substantially annular inflow opening 37 through which the inflowing gas is systematically guided into the intermediate space between the two members of the hollow body 20, and on the outlet side constitute outflow openings through which the gas is guided off again from the interior and the surroundings of the hollow body 20. The configuration of the wall members 32, 34 and the attachment of the hollow body 20 thereto will be discussed in more detail below.

The shape of the housing 12 itself can contribute to optimizing the gas flow through the exhaust gas treatment device 10. This will also be explained in detail below.

In one embodiment of the invention, the second wall member 34 is made to be flexible in the axial direction A. Such a wall member 34 is shown in FIGS. 5 and 6, for example. For this purpose, the wall member 34 includes an inner annular segment 38 and an outer annular segment 40, which are connected with each other by a plurality of webs 42, three in this example, which are uniformly distributed over the circumference of the wall member 34. Viewed in the radial direction r here, each of the webs 42 has two directly adjacent arched sections 44 formed therein in the shape of one wave crest and one wave trough, pointing in the axial direction A and in the opposite direction, respectively. Owing to this geometry, a flexibility of the inner annular segment 38 in relation to the outer annular segment 40 is obtained in the axial direction A, which is expressed in that the inner annular segment 38 can move in relation to the outer annular segment 40 by a predetermined distance in the axial direction A and in the direction opposite thereto. This axial compensation path preferably amounts to approximately 1 mm. In this way, a compensation may be obtained of the differences in length between the housing 12 and the hollow body 20 due to different coefficients of thermal expansion of the housing 12 and the hollow body 20. It is also possible to compensate for any manufacturing tolerances in the dimensions of the hollow body 20 and the housing 12 in this manner.

The webs 42 may also have a different shape which ensures the desired flexibility.

The inner and outer annular segments 38, 40 may be arranged in the same plane or slightly offset with respect to each other in the axial direction A.

Figure 7:
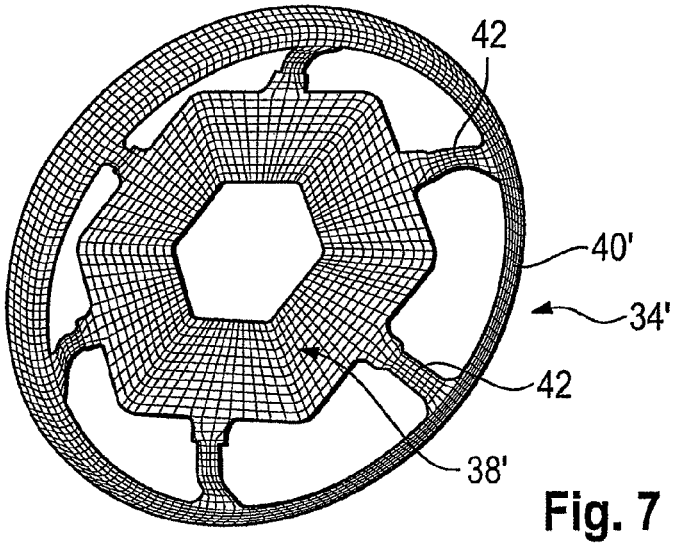
FIGS. 7 to 9 show different views of a flexible wall member in accordance with a variant.
Figure 8:
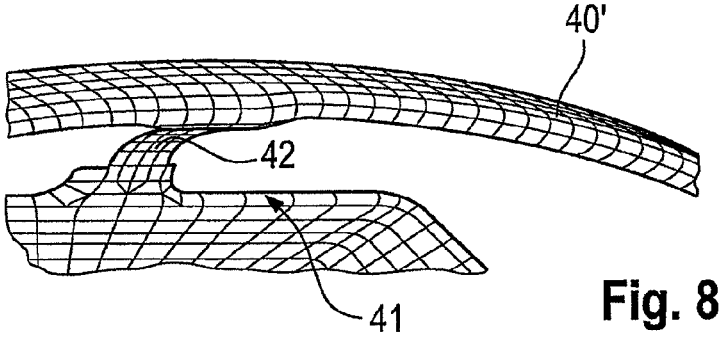
Figure 9:
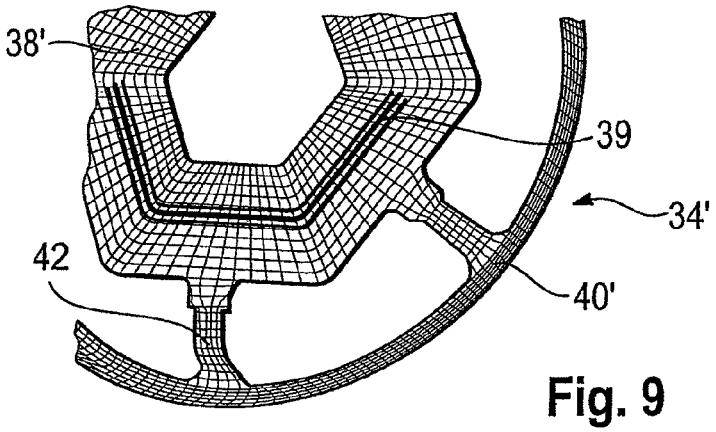
Figure 16:
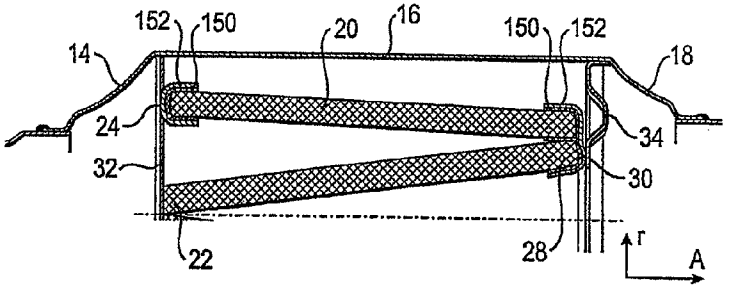
FIGS. 15 to 20 schematically show a second variant of the attachment of a hollow body of an exhaust gas treatment device according to the invention in a housing.

FIGS. 7 to 9 show a variant 34' of the wall member 34 just described. Provision is made here for a total of six narrow webs 42, which connect the inner annular segment 38' and the outer annular segment 40'. The inner annular segment 38' is in the form of a stiff bearing plate and will essentially not intrinsically deform in operation.

For an increase in stiffness, a stiffening profile 39 is formed on the surface of the annular segment 38' (see FIG. 9). In addition or as an alternative, the radially outer edge 41 (FIG. 8) of the annular segment 38' is bent over, likewise to increase the stiffness. The outer contour of the inner annular segment 38' is selected to be hexagonal here to match the cross-section of the end 28 of the hollow body 20'.

Figure 20:
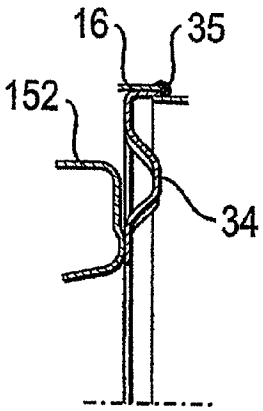

Following the attachment of the hollow body 20 to the wall member 34 during assembly of the exhaust gas treatment device 10, the wall member 34 is placed in its final axial position (indicated in FIG. 13) and is firmly welded or brazed to the outer wall of the housing (indicated by the weld seam 35 in FIG. 20).

The first wall member 32 could also be designed to be flexible in a suitable manner.

FIGS. 10 to 27 show different variants for attaching the hollow body 20 to the housing 12. Several examples of attachment will be described in more detail below. Of course, the illustrated examples may also be transferred to an attachment of a hollow body 20' as is shown in FIG. 2. But all other suitable methods of attachment are also applicable.

FIGS. 10 to 12 show a first variant.

FIG. 10 shows an attachment of the end 28, on the right in FIG. 1, of the hollow body 20. The boundary of the inner free space 46 of the wall member 34 is designed as a continuously encircling flange 48 projecting in the axial direction A. The end 28 of the hollow body 20 is attached to this flange 48. In the case shown, the flange 48 lies radially inside the hollow body 20, so that the latter is supported on the flange 48 all along its circumference.

To attach the end 28 of the hollow body 20 to the flange 48, a flexible fastening mechanism 50 of a fastening assembly is arranged radially outside the hollow body 20. The flexible fastening mechanism 50 is preferably formed to be flexible, i.e. elastically compressible, to a certain degree, at least in the radial direction r, but, if possible, in the axial direction A as well. The flexible fastening mechanism 50 may be, e.g., a wire mesh (as in the present example), or else a support mat as is used for attaching inserts in housings of exhaust gas treatment devices, or a fiber mat.

The purpose of the flexible fastening mechanism 50 of the fastening assembly is to distribute the contact pressure forces to the brittle substrate of the hollow body 20 along the circumference thereof and over the surface of the attachment as uniformly as possible so as to prevent any damage to the hollow body 20. In addition, it can compensate for the setting of the material of the hollow body 20 during the service life of the exhaust gas treatment device 10 so that the clamping force remains approximately constant. The flexible fastening mechanism 50 may also assume the function of a tolerance compensation between the hollow body 20 and the housing 12.

Arranged radially outside the flexible fastening mechanism 50 is a fixed fastening mechanism 52 which is likewise part of the fastening assembly and is formed by a metal band in one example. The flexible fastening mechanism 50 and the fixed fastening mechanism 52 are two separate components here, which are not put together until assembly of the exhaust gas treatment device 10.

To attach the hollow body 20 to the wall member 34, the end 28 of the hollow body 20 is fitted onto the flange 48, possibly accompanied by a calibration, i.e. the dimensions of the end 28 are adjusted to those of the flange 48 (or vice versa). The flexible fastening mechanism 50 is then placed around the end 28, so that a circumferentially closed wire mesh ring surrounds the end 28. Finally, the fixed fastening mechanism 52 is placed around this assembly and placed under tension, as is conventionally known. The ends of the metal band of the fixed fastening mechanism 52 are attached to each other, e.g. by welding, so that the assembly is held on the flange 48 by the clamping.

Alternatively or additionally, a flexible fastening mechanism 53 of the fastening assembly may also be arranged on the inside, that is, between the flange 48 and the end 28 of the hollow body 20 (see FIG. 12).

It would also be possible to arrange the end 28 of the hollow body 20 radially inwardly of the flange 48 and to provide a clamping ring, similar to the above-described metal band, as a radially innermost, fixed fastening mechanism, the clamping ring applying the necessary clamping force for the components to be held together.

The fixed fastening mechanism 52 may be welded or brazed to the second wall member 34.

An attachment analogous to that using the flange 48 on the second wall member 34 is, of course, also possible for the attachment of the first end 22 of the hollow body 20 to the first wall member 32. In the examples shown in FIGS. 1, 21, 31, 32, 33 and 36, for example, two flanges 48*a*, 48*b* (FIG. 31) arranged concentrically one around the other are provided on the wall member 32, each of the flanges serving to attach one of the axial ends of the two members of the hollow body 20. Each of the ends of the hollow body member is attached by way of a respective annular, flexible fastening mechanism 50 and an annular or band-shaped fixed fastening mechanism 52 engaging around the fastening mechanism 50, by analogy with the procedure described above.

Figure 21:
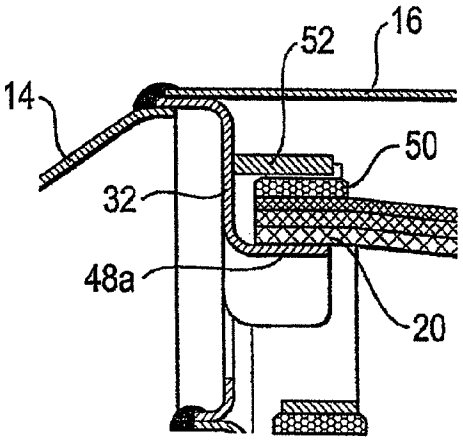
FIG. 21 shows a schematic illustration of a further variant of an attachment of a hollow body in the housing of an exhaust gas treatment device according to the invention.

FIG. 21 shows a variant in which the fixed fastening mechanism 52 is welded to the wall member 32.

Figure 14:
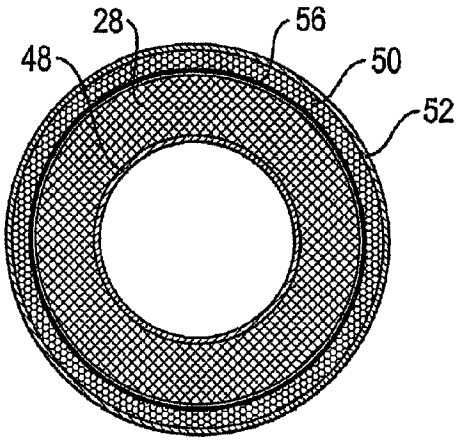
Figure 13:
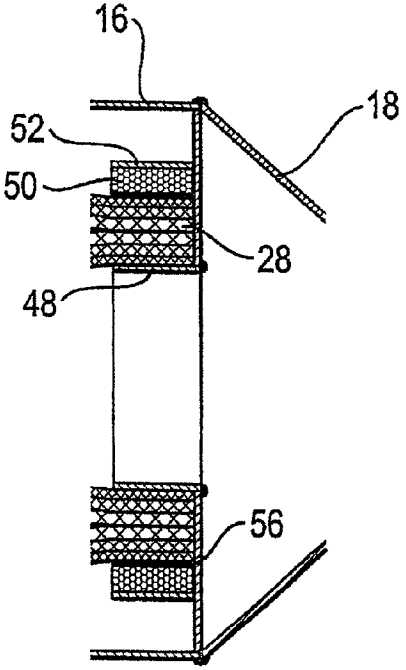

In the variant shown in FIGS. 13 and 14, a sliding layer 56, such as, e.g., a suitable coating, a suitable smooth film or a smooth wire mesh, is positioned between the outer surface of the end 28 of the hollow body 20 and the radially inward surface of the flexible fastening mechanism 50, the sliding layer 56 permitting a shifting of the flexible fastening mechanism 50 along the circumference of the rough substrate of the hollow body 20. Any rough surfaces of the hollow body 20 and of the flexible fastening mechanism 50 are thus prevented from getting entangled. In this way, the flexible fastening mechanism 50 can shift in relation to the hollow body 20 and the tightening forces applied during closure of the fixed fastening mechanism 52 can be distributed better.

The sliding layer 56 is provided specially on the ends 22, 28 of the hollow body 20 and only in these regions.

Figure 35:
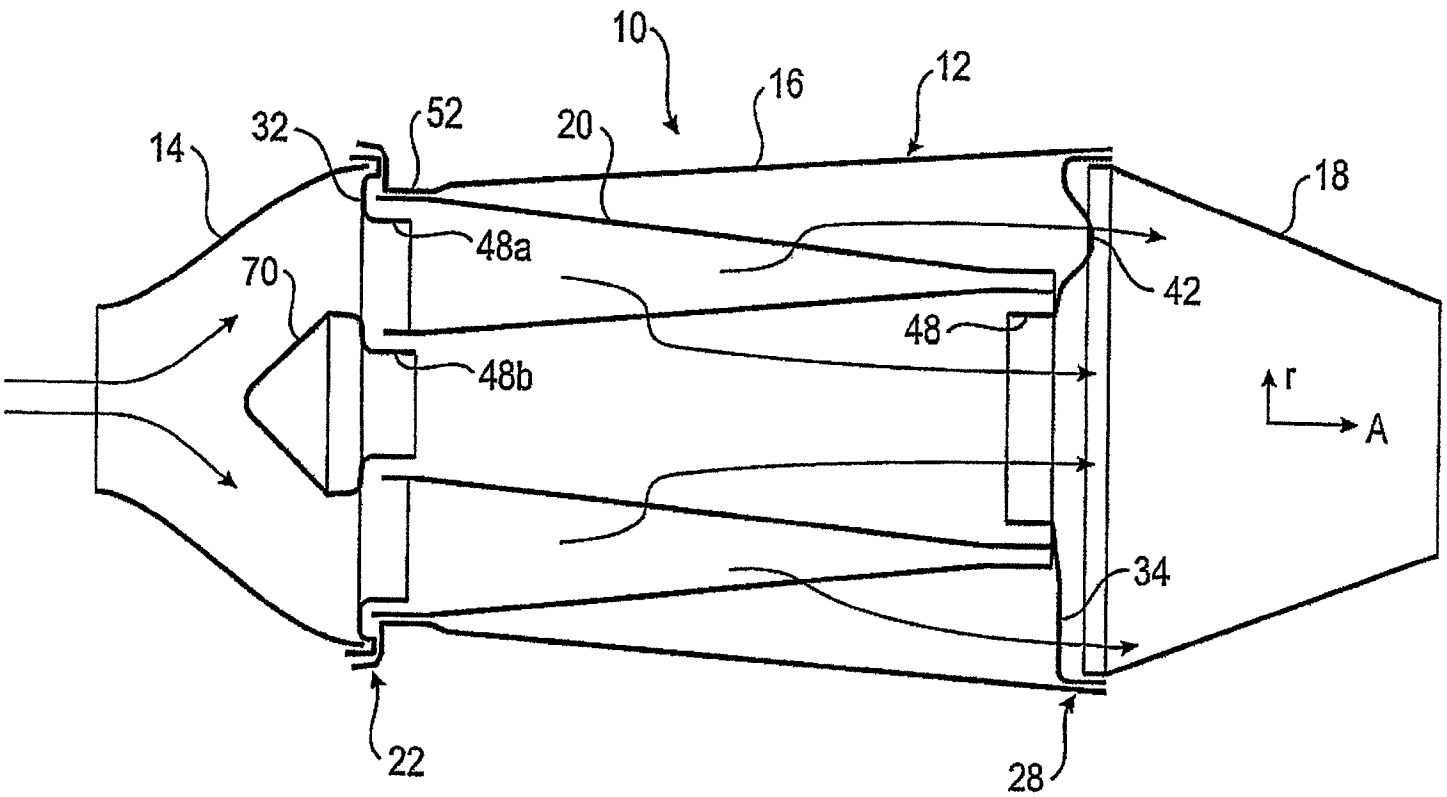
FIG. 35 shows a schematic sectional view of a housing of an exhaust gas treatment device according to the invention.

On the end 22, which corresponds to the inlet end of the hollow body 20, it is especially suitable for the attachment of the outer one of the two hollow body members that the function of the fixed fastening mechanism 52 is assumed by an appropriately shaped section of the outer wall of the housing, e.g. the wall of the flow-through region 16 (see FIGS. 35 and 36).

In this case, the outer wall of the housing 12 is deformed by the necessary predetermined extent to achieve a reliable attachment of the hollow body 20 and a clamping of the flexible fastening mechanism 50 located in between.

FIGS. 15 to 20 show a further variant to attach the hollow body 20 in the housing 12.

Here, the flexible fastening mechanism 150 is in the form of an annular profile which encompasses the end of the outer hollow body member at the end 22 of the hollow body 20. It is positioned between the front face 24 of the end and the first wall member 32 in the axial direction A. The flexible fastening mechanism 150 is for its part encompassed by a fixed fastening mechanism 152 which is in the form of a profile adapted to the shape of the flexible fastening mechanism 150. The fixed fastening mechanism 152 is disposed between the flexible fastening mechanism 150 and the first wall member 32 and is firmly attached to the wall member 32. The end of the inner hollow body member may also be appropriately bordered and be attached to the wall member 32 by mechanism of a fixed fastening mechanism 152.

The other end 28 of the hollow body 20 is correspondingly enclosed as well. However, two profiles or one profile in the shape of a FIG. 3 and having two recesses may be provided there to form the flexible fastening mechanism 150, so that each member of the hollow body 20 is enclosed separately (see, e.g., FIG. 16).

The fixed fastening mechanism 152, on the other hand, is a profile having only one recess, so that the end 28 of the hollow body 20 is completely enclosed, the flexible fastening mechanism 150 being arranged between the front face 30 of the hollow body 20 and the front face of the fixed fastening mechanism 152.

The flexible fastening mechanism 150 is preferably held in the fixed fastening mechanism 152 only by being clamped. The flexible fastening mechanism 150 may, however, also be welded, brazed or bonded, for example, to the substrate material of the hollow body 20. In the example shown, both the flexible fastening mechanism 150 and the fixed fastening mechanism 152 are designed as circumferentially closed, surrounding annular profiles, so that the front faces 24, 30 of the hollow body 20, optionally also the front face 26 of the inner hollow body member, are fully protected.

The fixed fastening mechanism 152 may be calibrated in the radial direction r to the dimensions of the end 22, 28 of the hollow body 20 by compression.

The fixed fastening mechanism 152 are each attached to the wall member 32, 34 (see, e.g., FIG. 16), for example by a weld seam. An attachment in some other way, e.g. by brazing or bonding, is also possible.

Figure 18:
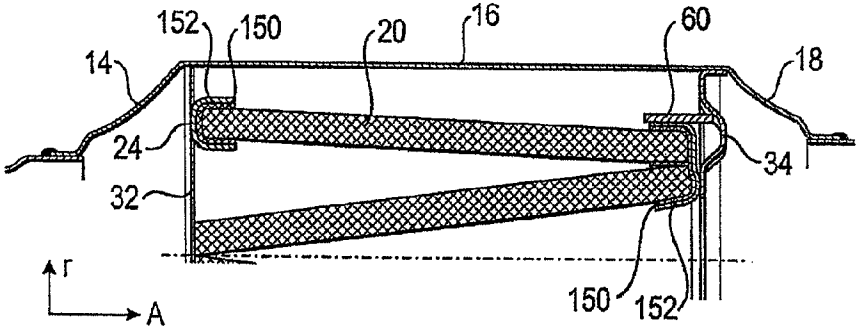
Figure 19:
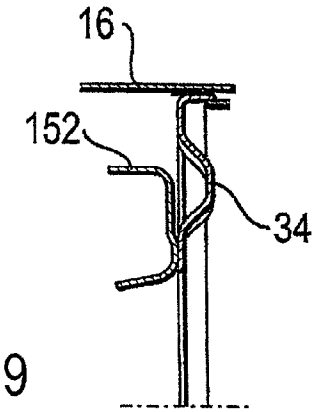

FIG. 18 shows a variant in which one leg of the profile of the fixed fastening mechanism 152 is attached by way of a carrier member 60.

The carrier member 60 is, on the one hand, welded to a leg of the fixed fastening mechanism 152 formed by the rigid profile and, on the other hand, firmly connected with the second wall member 34 by a weld seam. The carrier member 60 may be a sheet metal ring adjusted to the dimension of the end 28 of the hollow body 20, but a plurality of separate carrier members 60 could also be involved, which are distributed over the circumference of the end 28 of the hollow body. Rather than a welded joint, a brazed joint or an adhesive joint can also be made use of here.

Figure 22:
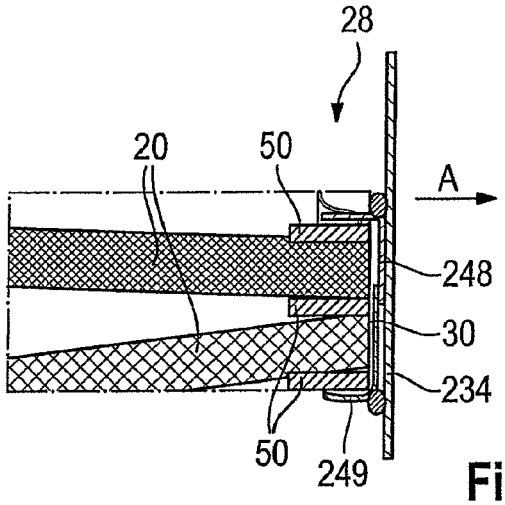
FIGS. 22 to 27 schematically show further variants for the attachment of a hollow body of an exhaust gas treatment device according to the invention in a housing.

FIG. 22 shows a further variant for attaching the hollow body 20 to the housing. In this case, the outlet side end 28 is fixed in place on the wall member 234. But the type of attachment may be transferred to the attachment of the inlet side end 22 without difficulty.

In this variant, the wall member 234 is configured to be substantially flat (see, e.g., FIG. 2). A first angular member 248 is attached to the wall member 34, e.g. by welding, so that one of the two angular sections projects from the wall member 234 in the axial direction A to constitute a radially inner support for the hollow body 20. A second angular member 249 is arranged on the other side of the hollow body in the radial direction r and fixed in place on the wall member 234, so that the end of the hollow body 20 is firmly fixed in position between the two angular members 248, 249.

To protect the substrate of the hollow body 20, flexible fastening mechanism 50, e.g. in the form of wire mesh layers, are arranged between the walls of the hollow body 20 and the angular members 248, 249 and also between adjacent walls of the hollow body 20 itself.

The angular member 248 may be formed as a ring or as a simple elbow, a plurality of angular members 248 being distributed over the circumference of the hollow body member in the latter case. The same applies to the angular member 249.

Figure 23:
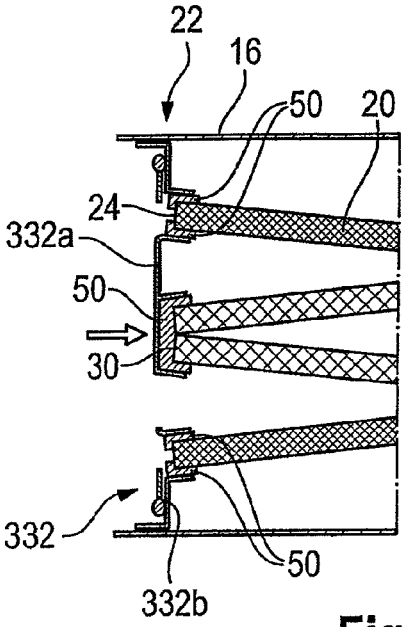

FIG. 23 shows a further variant for attaching the hollow body 20 to the housing. In this case, an attachment of the inlet side end 22 is illustrated, but the process may, of course, also be transferred to the attachment of the end on the outlet side.

The wall member 332 is composed of two parts, namely an inner bottom 332*a* and an outer ring 332*b*.

Also, in this case, flexible fastening mechanism 50, e.g. in the form of wire mesh rings, are placed around the ends of the hollow body segments, so that a direct contact between the substrate of the hollow body segments and the wall member 332 is avoided.

The inner bottom 332*a* has a central mount, closed on the front face, for the front face 26 of the inner hollow body segment and receiving sections for the front face 24 of the outer hollow body segment and is pushed onto the hollow body 20 from the inlet side and pressed on firmly. The outer ring 332*b* is pushed onto the hollow body 20 from the opposite side. In the process, a conically tapering circumferential section comes into contact with the flexible fastening mechanism 50, which surrounds the wall of the outer hollow body segment, and presses it together to such an extent that a firm contact is produced.

In a flat annular section, the outer ring 332*b* overlaps with a flat annular section of the inner bottom 332*a* and is welded thereto in the overlap region after the parts of the wall member 332 have been brought to their final positions.

This procedure results in the flexible fastening mechanism 50 being pressed in the radial direction at the gas inlet.

Figure 24:
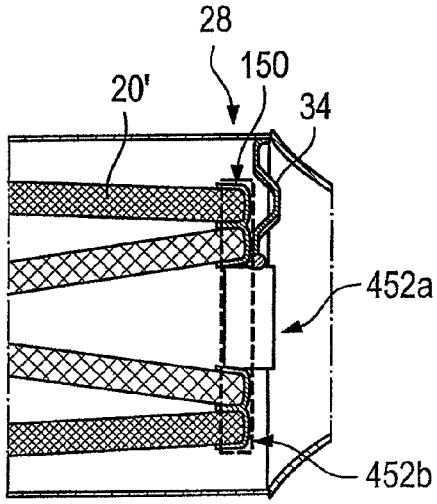

FIG. 24 shows a further option for attaching a hollow body, in particular in a pyramid shape, such as, e.g., the hollow body 20' having hexagonal hollow body members (see FIG. 4).

An attachment of the end 28 on the gas outlet side is illustrated here.

Figure 17:
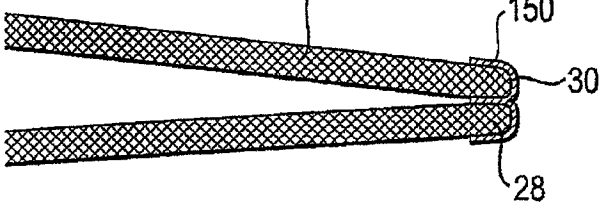
Figure 15:
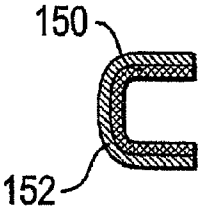

The front faces of the hollow body 20' are covered by a flexible fastening mechanism 150 having roughly the form as shown in FIG. 17.

A pair of tube sections having a polygonal, in this case hexagonal, cross-section are provided to form the fixed fastening mechanism 452*a*, 452*b*, the two tube sections being positioned radially inwardly and, respectively, radially outwardly of the hollow body 20' in the region of the end 28 thereof. Both tube sections may be calibrated during assembly, that is, their sizes may be adjusted to the dimensions of the hollow body 20' and, to this end, their diameters may both be reduced or increased.

The tube sections are in turn firmly connected to the wall member 34, for example by weld seams. It is also possible to design the wall member together with the tube sections as a drawn part.

This process is, of course, also transferable to hollow bodies having different geometries.

Figure 25:
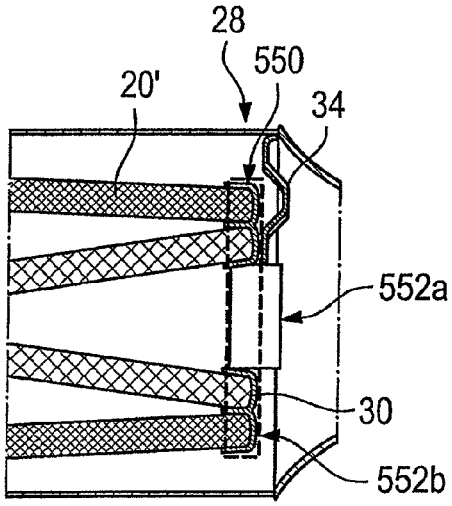
Figure 26:
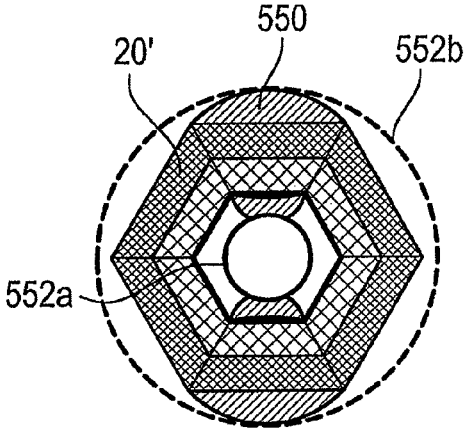

FIGS. 25 and 26 illustrate a variant of the technique just described. In this case, for the attachment of a pyramid-shaped hollow body 20', a pair of tube sections each having a round cross-section are provided radially inside and, respectively, outside the hollow body 20' to serve as fixed fastening mechanism 552*a*, 552*b*. To equalize the distances from the walls of the hollow body segments, provision is made for a profiled flexible fastening mechanism 550, which is formed from a wire mesh here. The flexible fastening mechanism 550 is shaped such that it compensates for the differences in distance between the corners of the hollow body segments and the round inside or outside of the tube sections. Otherwise the flexible fastening mechanism 550 is of the same design as, e.g., the fastening mechanism 150.

Figure 27:
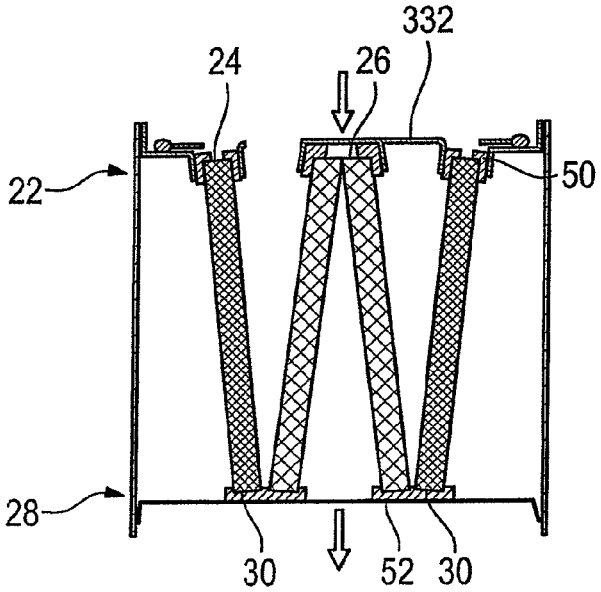

As shown in FIG. 27, a radial pressing operation at one end of the hollow body 20, as has been described in connection with FIG. 23, for example, may be combined with an axial pressing operation of the hollow body at the other end thereof.

Figure 28:
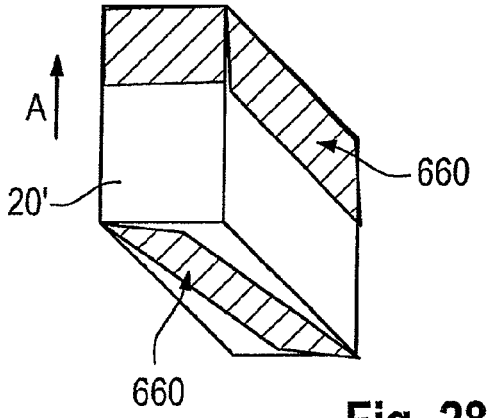
FIGS. 28 to 30 show various options of sealing the edges of a hollow body.
Figure 29:
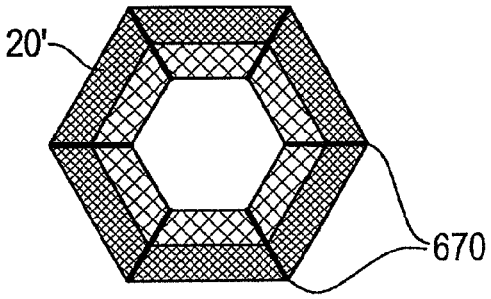
Figure 30:
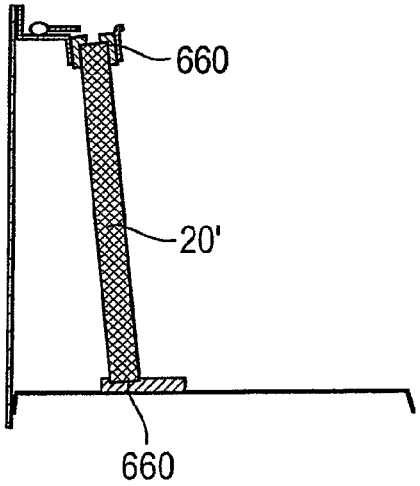

FIGS. 28 to 30 illustrate various ways of sealing the substrate of the hollow body members in the region of the ends 22, 28 of the hollow body 20, 20' such that it becomes substantially impermeable to gas.

The sealing 660 is preferably disposed at the points that are engaged by a flexible and/or a fixed fastening mechanism, for example on the surfaces adjacent to the ends or on the front faces of the hollow body members.

One option consists in pressing the substrate superficially in the end regions so as to seal the pores in a surface layer. The pressing may be performed in lateral and/or frontal sections, as related to the axial direction A.

As an alternative to pressing, the substrate may be coated in the end regions of the hollow body, for example by being soaked with a sealing slurry.

In this case, a fixing mechanism made from vermiculite, fibers or ceramic bands are preferably made use of as flexible fastening mechanism.

In particular in the case of pyramid-shaped hollow bodies, it is possible to insert thin strips 670 made of paper or ceramics between the individual plates of the hollow body segments and to press the cut edges of the plates there. The sealing 660 may also be configured as a sliding layer, analogously to the above-described sliding layer 56.

All of the wall members may, but need not, be designed to be flexible.

All of the variants shown may be adjusted both to hollow bodies having round cross-sections and to hollow bodies having polygonal cross-sections and also to the use at the end on the inlet side or on the outlet side, even if they have each been described for one special case only.

Figure 31:
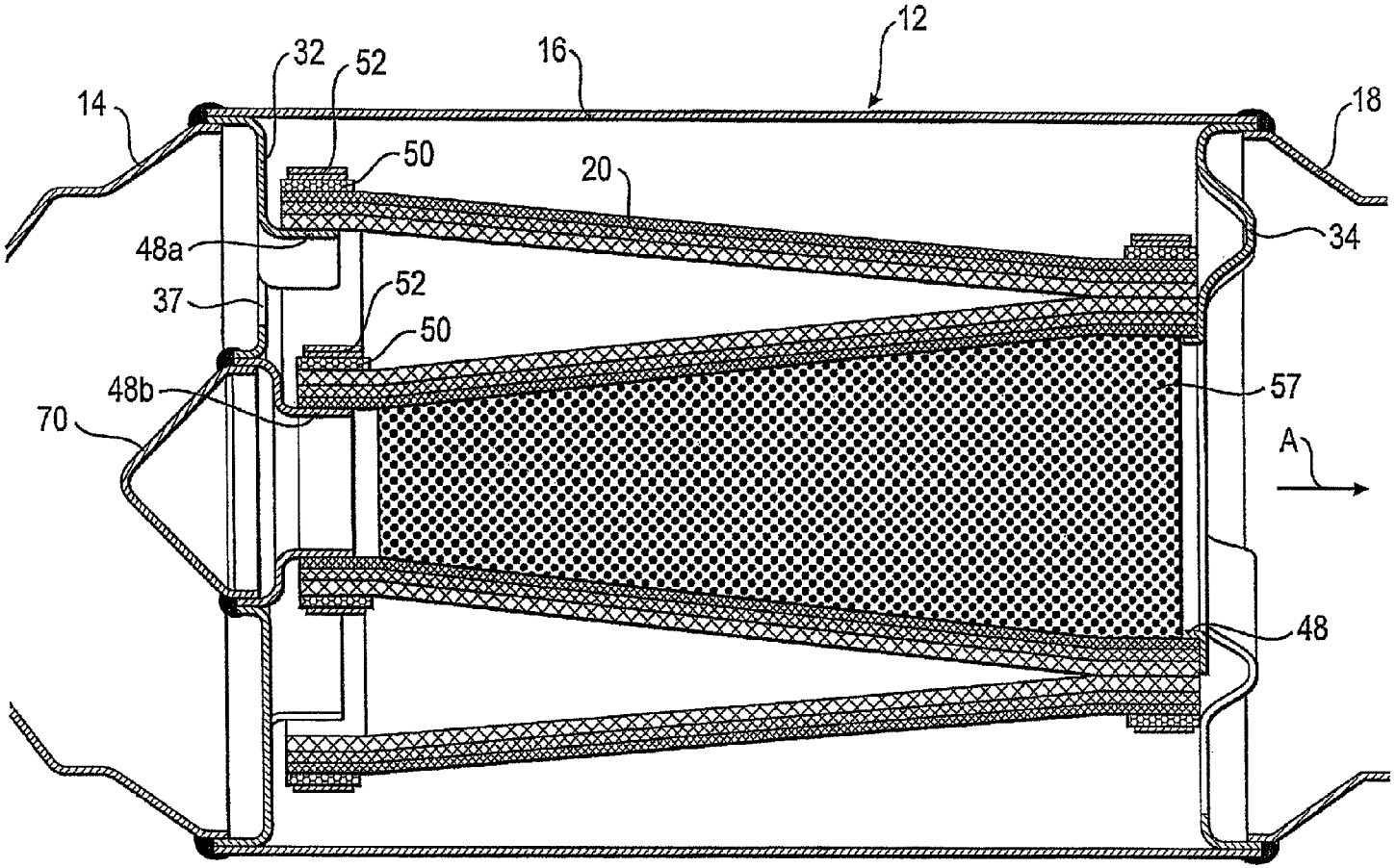
FIGS. 31 and 32 each show a schematic section taken through an exhaust gas treatment device according to the invention including a support body.
Figure 32:
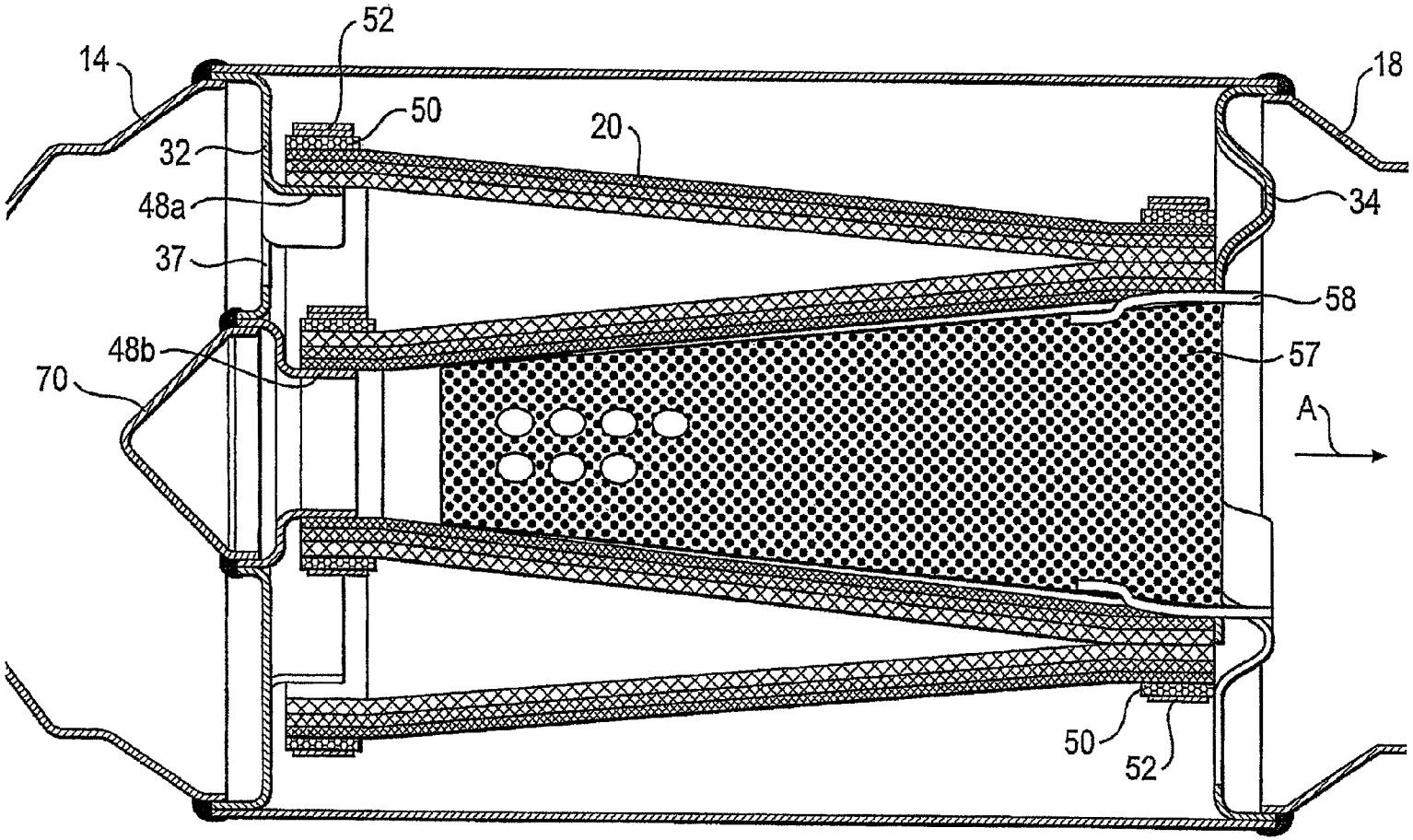
Figure 33:
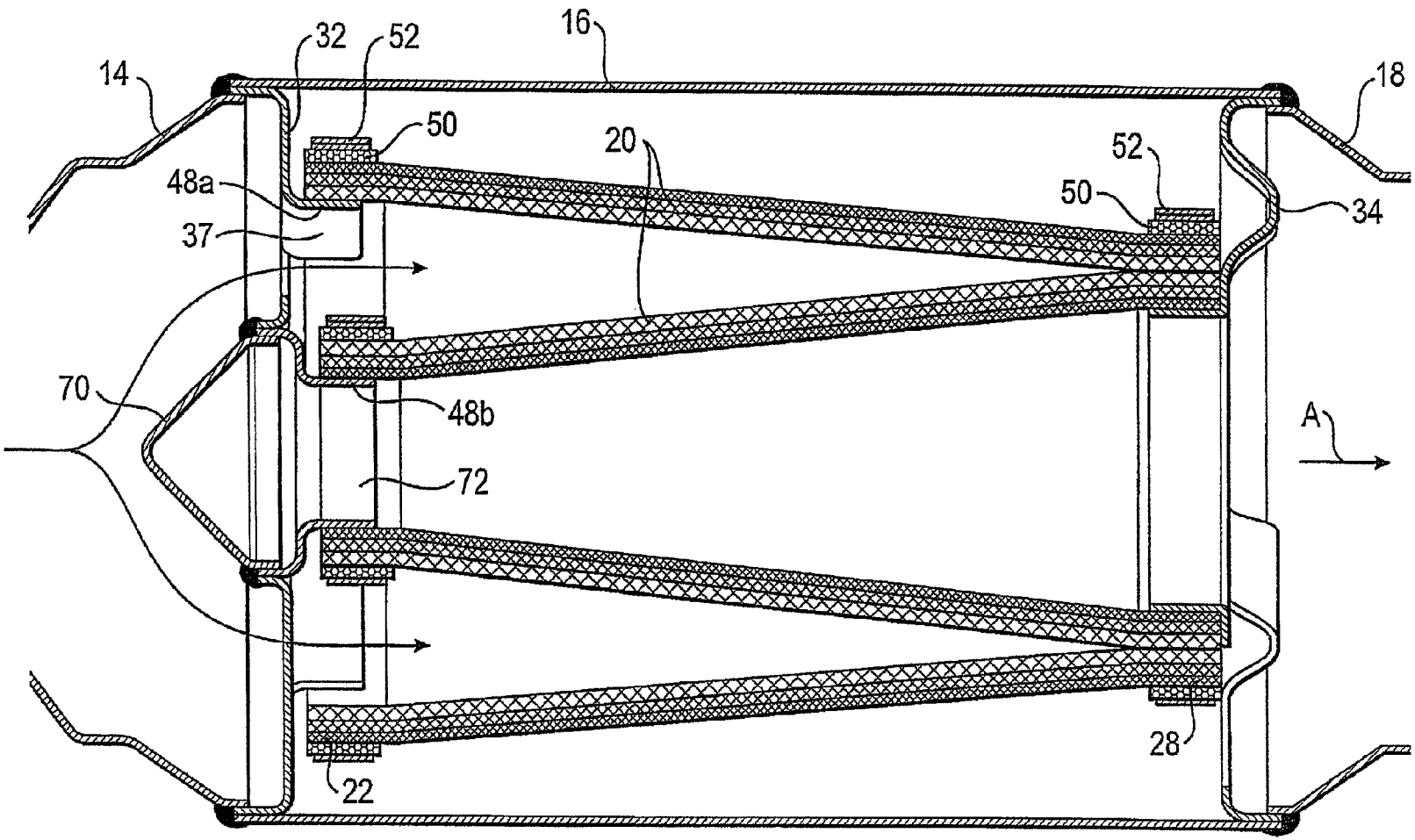
FIG. 33 shows a schematic section taken through an exhaust gas treatment device according to the invention including a flow guide member.

As shown in FIGS. 31 and 32, it is possible to insert a support body 57, adapted in shape, into the innermost cavity 54 of the hollow body 20. The support body 57 consists of, e.g., a perforated plate or a different dimensionally stable and stressable, but gas permeable material. Both axial ends of the support body 57 are preferably open. The innermost wall of the hollow body 20 is supported on the support body 57.

As shown in FIG. 32, for attachment the support body 57 may rest under pretension against the second wall member 34 by way of an appropriately pre-bent ring member 58, and the ring member 58 may be, e.g., welded to the wall member 34.

The gas permeability may vary along the axial direction A, for example, as is indicated in FIG. 32 by the distribution of the openings. The different perforations and/or porosities of the support body 57 allow the gas flow and the distribution of the particle deposition to be controlled.

The first wall member 32 restricts the flow cross-section of the housing 12 to an annular inflow opening 37 (interrupted only by webs 42 extending in the radial direction r), see, e.g., FIG. 1, which substantially corresponds to the annular gap between the ends of the hollow body members. In the example shown, exhaust gas passes from the inlet region 14 through the inflow opening 37 into the flow-through region 16.

FIGS. 31 to 34 show various ways of systematically controlling the flow in the housing 12 of the exhaust gas treatment device 10.

In the variant illustrated in FIG. 31, a conical flow guide member 70 is arranged in the inlet region 14, which guides the exhaust gas stream to the annular inflow opening 37 of the first wall member 32. As a result, the inflowing exhaust gas directly reaches the annular gap formed by the two members of the hollow body 20 on the inflow side, without impinging on a wall perpendicular to the flow direction.

The tip of the cone of the flow guide member 70 is rounded. The conical flow guide member 70 is attached to the first wall member 32. It may be arranged on the wall member 32 as a separate component or else constitute an integral part of the wall member 32. The flow guide member 70 is simple to manufacture by drawing from sheet metal.

The flow guide member 70 usefully seals the opening 72 of the inside of the flange 48*b* since at this point, of course, no gas is to reach the flow-through region 16.

The geometry of the first wall member 32 is illustrated in greater detail in FIG. 34. As with the above-described second wall member 34, provision is made for an inner annular segment 38 and an outer annular segment 40, which are connected with each other by three webs 42 distributed along the circumference. The two flanges 48*a* and 48*b* extending on that side of the wall member 32 facing away from the flow guide member 70 on the inner and outer annular segments 38, 40, respectively, are each concealed by the members of the hollow body 20 and the fixed fastening mechanism 52 in FIG. 34.

As an assistance in guiding the flow, the housing 12 may have a streamlined shape in the area of the inlet region 14, as is illustrated in FIG. 35. FIG. 35 is a schematic view of the exhaust gas treatment device 10 in which those of the above-discussed elements which are not illustrated have been omitted for reasons of clarity only.

In this case, the first wall member 32 is appropriately adjusted to the dimensions of the inlet region 14.

The outer wall of the inlet region 14 runs in a curved shape, which is favorable in terms of flow, to the first end 22 of the hollow body 20 and is connected with the first wall member 32. The end of the inlet region 14 is adjoined by the beginning of the flow-through region 16, the wall of the flow-through region 16 also being connected with the first wall member 32 in the immediate vicinity of the end 22 of the hollow body 20.

The object of this design is to avoid a dead space in the radial direction r between the end 22 of the hollow body 20 on the inflow side and the inside of the wall of the flow-through region 16.

In the axial direction A, the housing 12 widens in the shape of a funnel in the flow-through region 16. The walls may have a linear slope here, so that the flow-through region 16 widens conically, or else a curved shape. The cross-section of the flow-through region 16 may be circular, oval, or polygonal (preferably with rounded corners), or have any desired free shape. The shape of the flow-through region 16 can be established by a person skilled in the art in accordance with fluidics-related considerations in line with the particular intended application.

That area of the housing 12 of the flow-through region 16 that is immediately adjacent to the first wall member 32 serves as a fixed fastening mechanism 152 for attachment of the outer one of the hollow body members to the flange 48*a* of the wall member 32. The housing 12 could also be reduced in diameter only in the area serving as the fixed fastening mechanism 152.

It is also possible for the flow-through region 16 to taper, rather than widen, in the axial direction A.

At the transition from the flow-through region 16 to the outlet region 18, the end of the wall of the flow-through region 16 and the beginning of the wall of the outlet region 18 converge at the second wall member 34.

As described above, the second end 28 of the hollow body 20 is attached to the flange 48 of the second wall member 34.

Here, too, one or both of the wall members 32, 34 may be made to be flexible in the axial direction A, for example in one of the forms described above.

All of the housing parts, i.e. those of the inlet region 14, those of the flow-through region 16, and those of the outlet region 18, may be welded to each other and/or to the wall members 32, 34, as is shown for the housing of the flow-through region 16 and the first wall member 32 in FIG. 36.

All of the features described and shown of the various embodiments may be freely combined with, or replaced by, one another at the discretion of a person skilled in the art. In particular, the use of a flexible wall member, the use of the methods described above of attaching and sealing the hollow body, and the configurations described above of the housing for optimizing the gas flow are independent of each other.

Rather than comprised of two truncated cones nested inside each other as described here, the hollow body 20 could, of course, also be designed differently; it could consist of, e.g., two cylinders, in particular circular cylinders, fitted into each other, or cylinders composed of straight, flat plate sections. In place of the conical or frustoconical members, pyramidal or frustopyramidal members having any desired number of sides may also be used.

In particular, only the outer one of the two members could have a cylindrical shape.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. An exhaust gas treatment device comprising:

a housing defining an axial direction from an inlet to an outlet; and at least one hollow body through which exhaust gas flows and which is accommodated in the housing and is at least partly comprised of a gas permeable substrate, wherein at least one end of the at least one hollow body is connected to a wall member which is arranged in the housing, the wall member formed to be flexible in the axial direction;

the wall member including a radially inner annular segment and a radially outer annular segment that are connected to each other by at least two webs; and the at least one hollow body being attached to the radially inner annular segment.

2. The exhaust gas treatment device according to claim 1, wherein the at least two webs include at least one section that is arched out of an axial plane in a radial direction.

3. The exhaust gas treatment device according to claim 1, wherein the radially outer annular segment is attached to the housing.

4. The exhaust gas treatment device according to claim 1, wherein the wall member has a flange configured thereon, the one end of the hollow body being attached to the flange.

5. The exhaust gas treatment device according to claim 4, wherein the flange is adjusted to a diameter of the one end of the at least one hollow body.

6. The exhaust gas treatment device according to claim 1, wherein the housing has an inlet region, a flow-through region, and an outlet region which are disposed one behind the other in the axial direction, and the wall member is attached in a region of a transition from the flow-through region to the outlet region or in a region of a transition from the inlet region to the flow-through region.

7. The exhaust gas treatment device according to claim 1, wherein the radially inner annular segment includes a stiffening profile.

8. The exhaust gas treatment device according to claim 1, wherein the radially inner annular segment includes a bent-over edge.

9. The exhaust gas treatment device according to claim 1, wherein the radially inner annular segment includes at least one of a stiffening profile and a bent-over edge, and wherein the at least one of the stiffening profile and the bent-over edge accommodate(s) a flexible fastening member.

10. The exhaust gas treatment device according to claim 1, wherein the hollow body is comprised of a plurality of layers of the gas permeable substrate.

11. The exhaust gas treatment device according to claim 10, wherein the plurality of layers are comprised of a plurality of plates.

12. The exhaust gas treatment device according to claim 1, wherein the hollow body is comprised of at least one pair of truncated cones fit inversely into each other.

* * * * *